US006068308A

United States Patent [19]

Molzer

[11] Patent Number: 6,068,308

[45] Date of Patent: May 30, 2000

[54] LATCH ASSEMBLY

[75] Inventor: Klaus Molzer, Nässjö, Sweden

[73] Assignee: Austin Hardware, Inc., Minneapolis, Minn.

[21] Appl. No.: 09/042,233

[22] Filed: Mar. 13, 1998

[51] Int. Cl.[7] ..... E05B 3/00

[52] U.S. Cl. ..... 292/336.3; 292/DIG. 62; 70/212

[58] Field of Search ..... 292/200, 202, 292/205, 207, 210, 226, 336.3, DIG. 30, DIG. 62; 70/208, 209, 224, 203, 210, 212, DIG. 63

[56] References Cited

U.S. PATENT DOCUMENTS

| | | | |
|---|---|---|---|
| 4,583,775 | 4/1986 | Bisbing . | |
| 4,763,935 | 8/1988 | Bisbing . | |
| 5,299,597 | 4/1994 | Fort | 70/203 |
| 5,390,517 | 2/1995 | Yamada | 70/210 |
| 5,634,357 | 6/1997 | Nutter | 70/210 |
| 5,664,448 | 9/1997 | Swan | 70/203 |

*Primary Examiner*—B. Dayoan
*Assistant Examiner*—Gary Estremsky
*Attorney, Agent, or Firm*—Edwin E. Voigt II; Vidas, Arrett & Steinkraus

[57] ABSTRACT

A latching assembly that requires three distinct operations must be performed with two hands to allow the handle of the latch assembly to be rotated to unlock a door from a door frame. The assembly provides substantial flexibilities in installation. A base portion having a sleeve which defines an aperture is secured to a door and receives a handle portion with a shaft attached, the shaft extending through the aperture in the sleeve. Cooperative rotation restriction portions on the handle and on the base portion restrict the rotation of the handle to a limited range. The limited rotation range may be altered by selectively positioning a key guide in one of the cooperative rotation restriction portions. A first release mechanism comprising a trigger portion which extends from the handle and a detent which engages a detent opening in the base portion requires depression of the trigger portion before rotation of the handle to an unlatched position. The detent mechanism is within the handle and a cap contains and encloses in the detent mechanism. The cap portion has a bore which receives a second release mechanism which has a shaft portion which may be exteriorly manipulated to move an obstructing member into or out of an obstructing relation with the detent. Thus, the second release mechanism must be manipulated to allow release of the trigger portion which must then be depressed to allow rotation of the handle. The cap portion is secured in the handle by screws or other threaded members extending from the handle base portion interface into the cap.

15 Claims, 5 Drawing Sheets

LATCH ASSEMBLY

BACKGROUND OF THE INVENTION

This invention relates to latches and more particularly relates to latch assemblies utilizing handles and secondary handle release mechanisms for use with cabinets and the like.

Latch assemblies with handles are known which are lockable by utilization of an internal lock cylinder which prevents the handle from rotating. Typically these latch assemblies can be locked and unlocked and remain in the unlocked position whereby the handle and door attached thereto may be opened with one hand. Standards adopted in the telecommunications industries require that two hands be utilized to operate certain cabinet latching assemblies. There has been minimal development of effective and convenient latching assemblies which have this feature. Additional locking features to accommodate a padlock is also desirable as the primary locking means or a secondary locking means on such latching assemblies. Prior art latch assemblies, particularly locking latch assemblies, normally lack flexibility in being adaptable for varying applications, for example a left or right hand door.

SUMMARY OF THE INVENTION

The present invention provides latching assembly that requires three distinct operations which must be performed with two hands to allow the handle of the latch assembly to be rotated to unlock a cabinet door or the like. Moreover, the design allows substantial flexibilities in installation.

A base portion with a sleeve is secured to a door and receives a handle portion with a shaft attached, the shaft extending through the sleeve. Cooperative rotation restriction portions on the handle and on the base portion restrict the motion of the handle to a limited rotation range. Said limited rotation range may be altered by selectively moving a key guide in one of the cooperative rotation restriction portions. A first release mechanism comprising a trigger portion which extends from the handle and a detent mechanism which engages a detent opening in the base portion which requires depression of the trigger portion before rotation of the handle to an unlatched position. The detent mechanism is within the handle and a cap contains and encloses in the detent mechanism. The cap portion has a bore which receives a second release mechanism which has a shaft portion that may be exteriorly manipulated to move a obstructing member into and out of an obstructing relation with the detent. Thus, the second release mechanism must be manipulated to allow release of the trigger portion which must then be depressed to allow rotation of the handle. The cap portion is secured in the handle by screws or other threaded members extending from the handle base portion interface into the cap.

A feature and advantage of the invention is that a finger operated slide member must be depressed into the handle before rotation of the handle.

A feature and advantage of the invention is that a release mechanism positioned in the head of the handle must be rotated to allow the handle to be rotated.

A further feature and advantage of a preferred embodiment is that the release shaft portion must be rotated before the finger operated slide member may be depressed into the handle.

A further feature and advantage of the invention is that the handle when rotated to the unlatched second position is retained in place by the slide member engaging a second detent recess.

A further feature and advantage of the invention is that the handle is easily convertible from a clockwise unlatching rotation to a counterclockwise unlatching rotation by simple internal alteration. The same latching assembly can thus be used for either right or left hand opening doors.

A feature and advantage of the invention is that with the same handle, base portion, and shaft, a blank plug may be inserted into the head of the handle eliminating the release shaft portion such that the latching assembly may be operated with one hand.

A feature and advantage of the invention is that the release shaft portion may utilize a key operated insert, either radial pin-tumblers or normal flat key cylinders.

An additional advantage and feature of the invention is that three separate actions are required to unlatch the latching assembly and only a single action, rotation of the handle is necessary for latching the latching mechanism.

DETAILED SPECIFICATION

Figure 2:
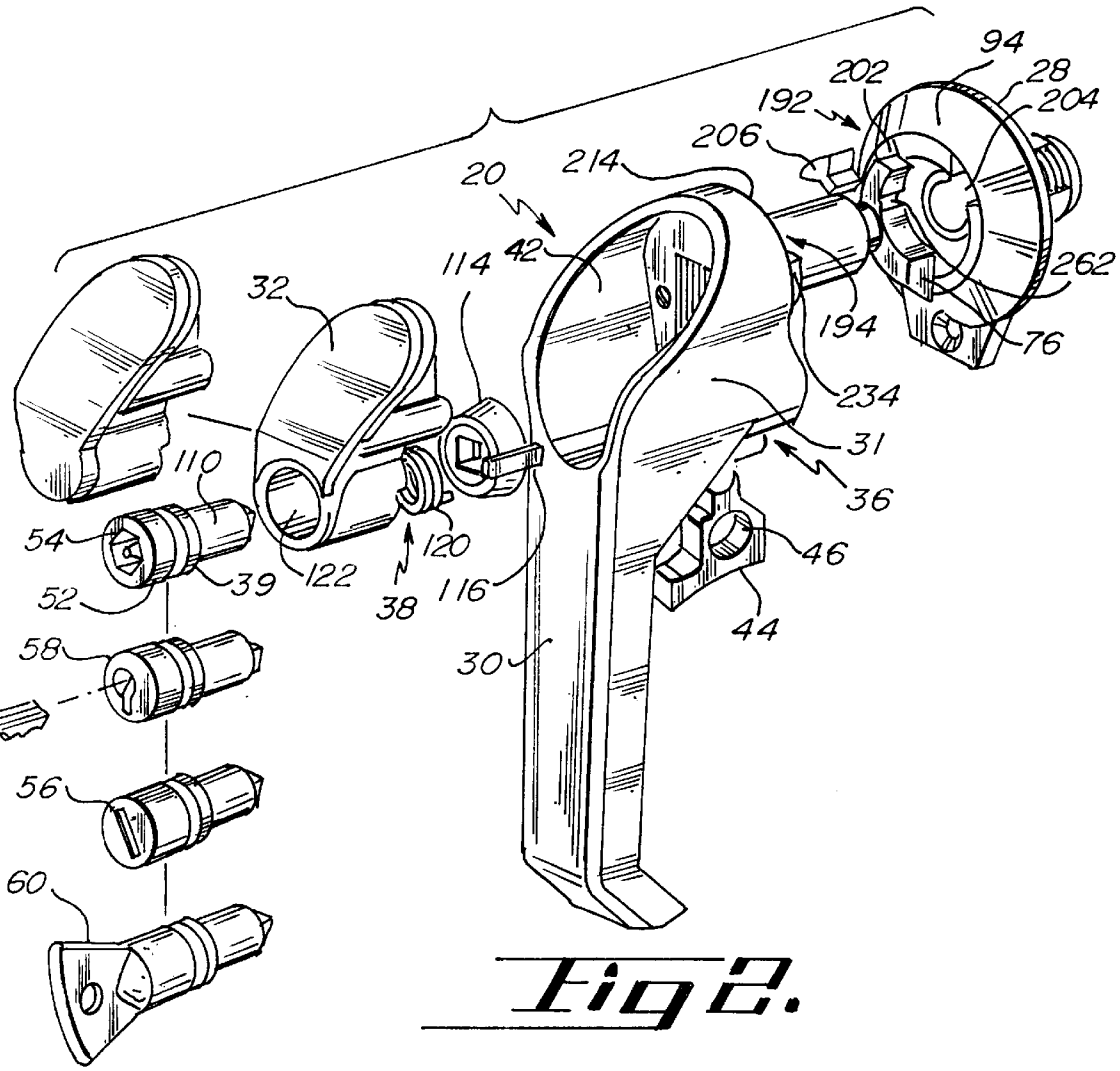
FIG. 2 is a exploded perspective view of the latch assembly showing alternative shaft portion ends.
Figure 1:
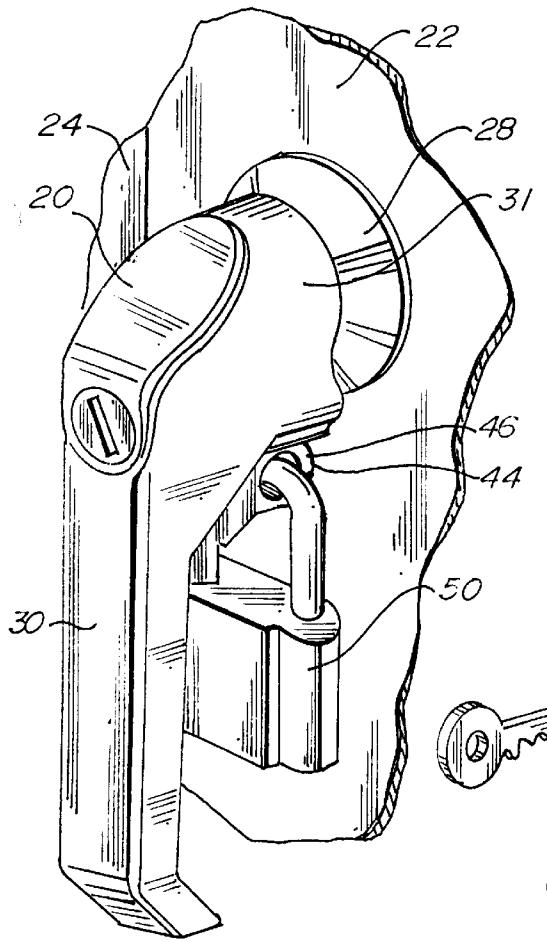
FIG. 1 is a perspective view of the latch assembly in place on a door with padlock.

Referring to FIGS. 1 and 2, the latching mechanism is shown in position on a door and in an exploded view. The latching mechanism is generally designated with the numeral 20 and is intended to be secured to a door 22 in a door frame 24. The latching mechanism is principally comprised of a base portion 28 with a sleeve 29 defining an aperture 33 sized to rotatingly receive a shaft, a handle 30, a plug or cap 32, a shaft 34, a first release mechanism 36 and a second release mechanism 38. The handle as a head portion 31 with a open interior configured as a cap or plug receiving region 42.

Figure 4:
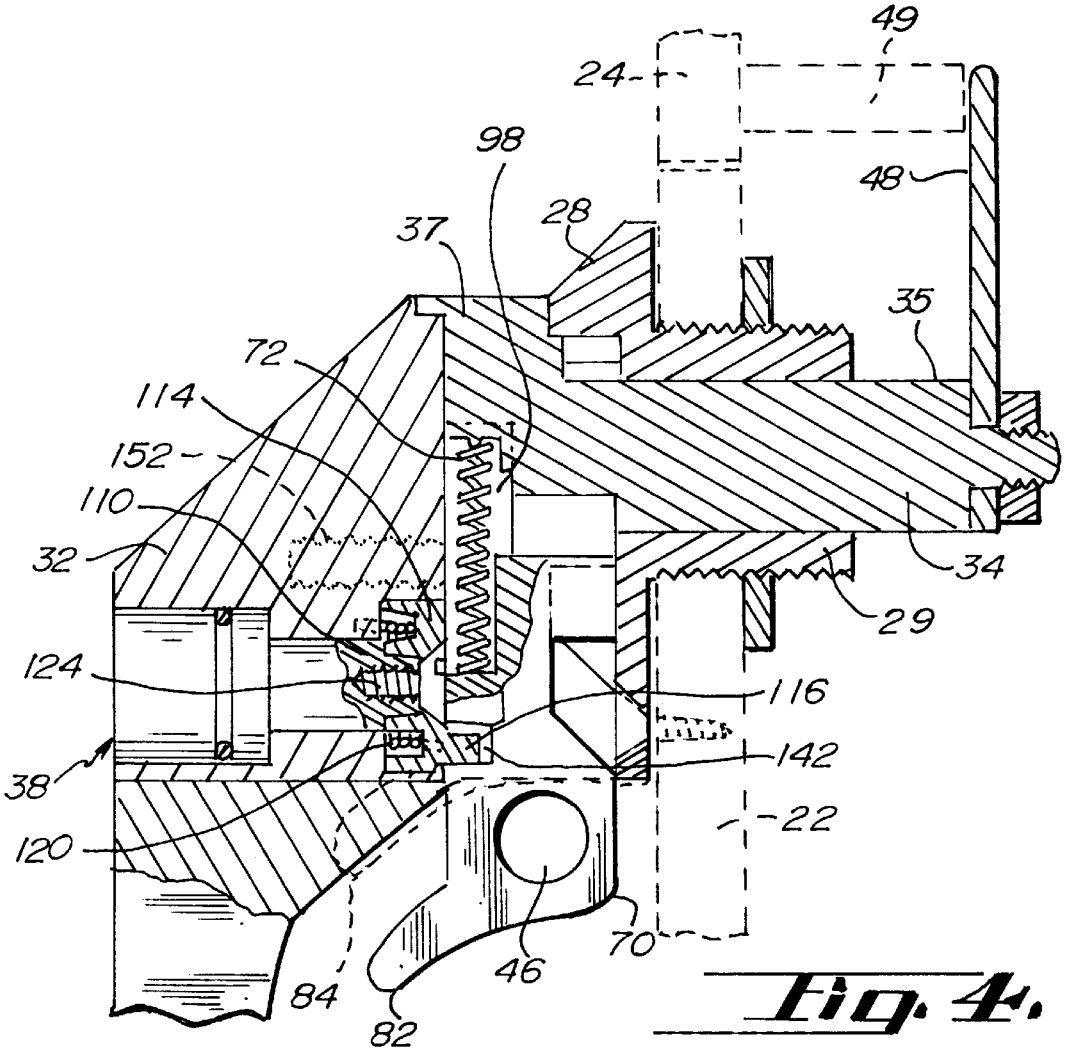
FIG. 4 is a cross-sectional view through the device.

The first release mechanism is a detent mechanism in the preferred embodiment and has a protruding portion configured as a trigger portion 44 which comprises a loop 46 sized for receiving a padlock 50. The second release mechanism 38 has a first end 39 which may be a tool receptacle 54, 56 or a key cylinder 58 or a manually manipulatable member 60 and a second end that interferes or obstructs the operation of the detent mechanism. Thus, the rotation of the handle and the actuation of the latch member 48 involves sequential actuation of the second release mechanism by rotation of the first end and depression of the trigger portion 44 at which point the handle 30 may be partially rotated to release an internal latch member 48 from a latch receiver 49 as shown in FIG. 4. The shaft 34 has a first end 35 and a second end 37 and may have any conventional configuration with the latching member 48 attached to the first end 35 by any suitable means, the shaft received for rotational movement in the aperture 33 of the base portion 28.

Figure 3A:
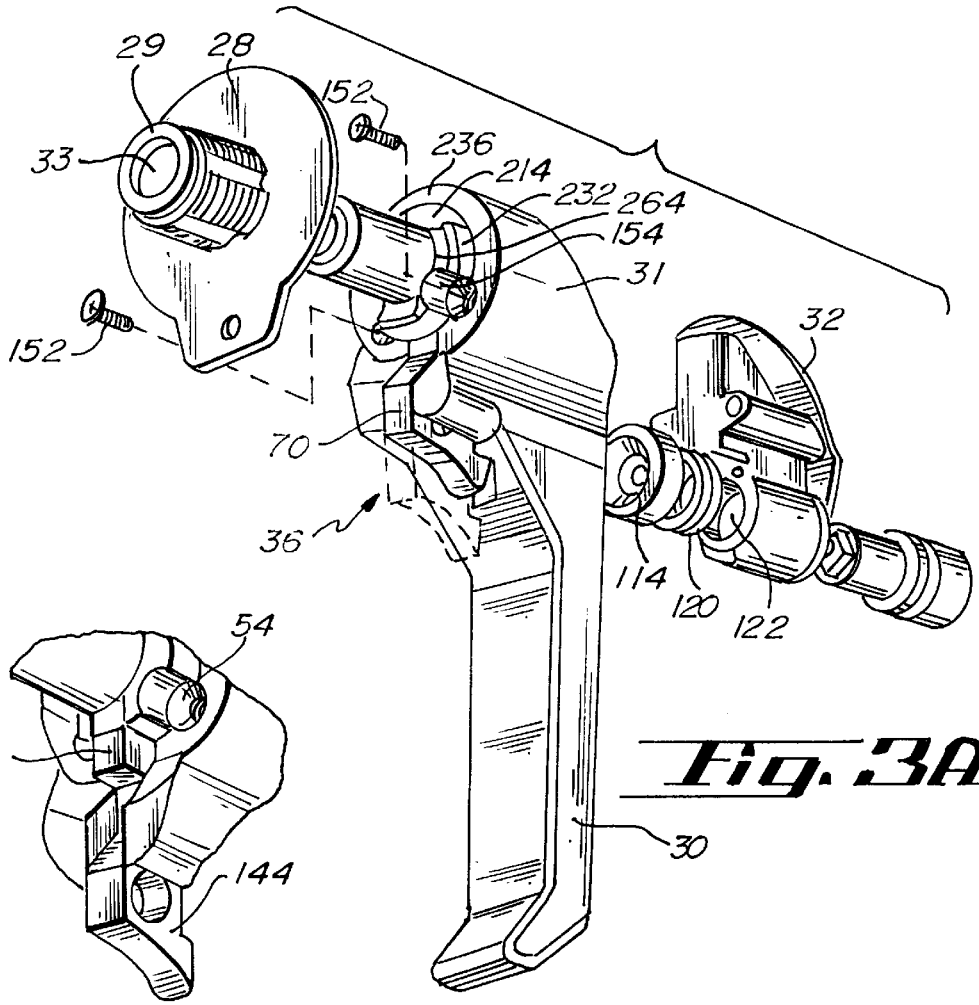
FIG. 3A is an exploded perspective view of the invention.
Figure 3B:
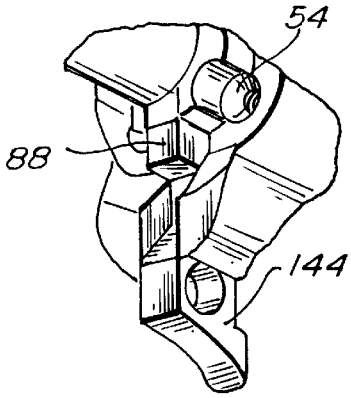
FIG. 3B is a portion of FIG. 3A with the trigger portion in a different position.
Figure 3C:
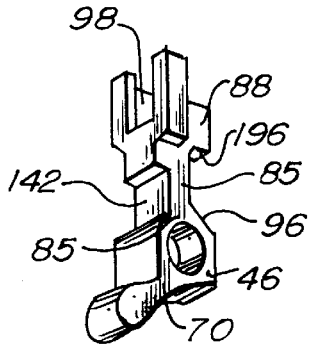
FIG. 3C is a detailed perspective view of the slide member including the trigger portion.

Details of the first release mechanism 36 are as follows. Referring to FIGS. 3A, 3B, 3C, 4, 5, 6, and 7, the components of the first release mechanism 36 are the finger operated slide member 70 which is shown in isolation in FIG. 3C, the spring 72, which provides a downward bias to the slide member 70, the base portion 28, specifically the first slot 76, and the handle 30, specifically the second slot 80. Due to this bias, the slide member 70 is normally in the extended position as shown in FIGS. 3B and 4 in the solid lines and is indicated with the numeral 82. The depressed position as shown in FIG. 3A in slotted lines and in FIG. 4 in dashed lines has been designated with the numeral 84.

Note that the slide member has regions of reduced cross sectional portion 85 where the protruding portion extends from the head of the handle whereby when the protruding portion receives a sharp impact such as from someone trying to remove the padlock, the slide member tends to fracture at said reduced cross sectional portion inhibiting further movement of the slide member from the extended position to the depressed position.

The slide member 70 has an interference portion or detent 88 which in the extended position is positioned in the slot 76 preventing rotation of the handle 30 and shaft 34 with respect to the base portion 28. Depression of the trigger portion 44 extends the detent 88 upwardly out of the way of the frustoconically shaped collar portion 94 of the base portion 28. In such a position the recess 96 on the slide member which conforms to the shape of said frustoconical portion of the base portion freely rotates about the exterior of said frustoconical portion as the handle is rotated. The spring is contained in a spring containment region 98.

The second release mechanism 38 is best shown in FIGS. 2, 3A, 4, and 6. The mechanism 38 has a shaft portion 110 which is comprised of the rotatable portions such as the first end 39 to the opposite end 114 which is configured as a cylindrical member with an obstructing portion 116.

A torsion spring 120 is engaged with the cylindrical member 114 and the cap 32 is constrained by and fits in the bore 122. A screw 124 secures the cylindrical member 114 to the first end of the shaft portion. The obstructing portion 116 rotates with the shaft portion between a obstructing position as indicated with the numeral 130 and a non-obstructing position as indicated with the numeral 132. The handle has a recess 134 in which the obstructing portion travels and has a first stop portion 136 and a second stop portion 138 both of which in the preferred embodiment are integral with the handle 30. The obstructing portion 116 in the obstructing position engages with the slot 142 of the slide member 70. The second release mechanism is secured within the head of the handle portion 30 by securing the cap 32 to the handle head by way of screws 152 in the screw recesses 154 as best shown in FIG. 3A.

Figure 9:
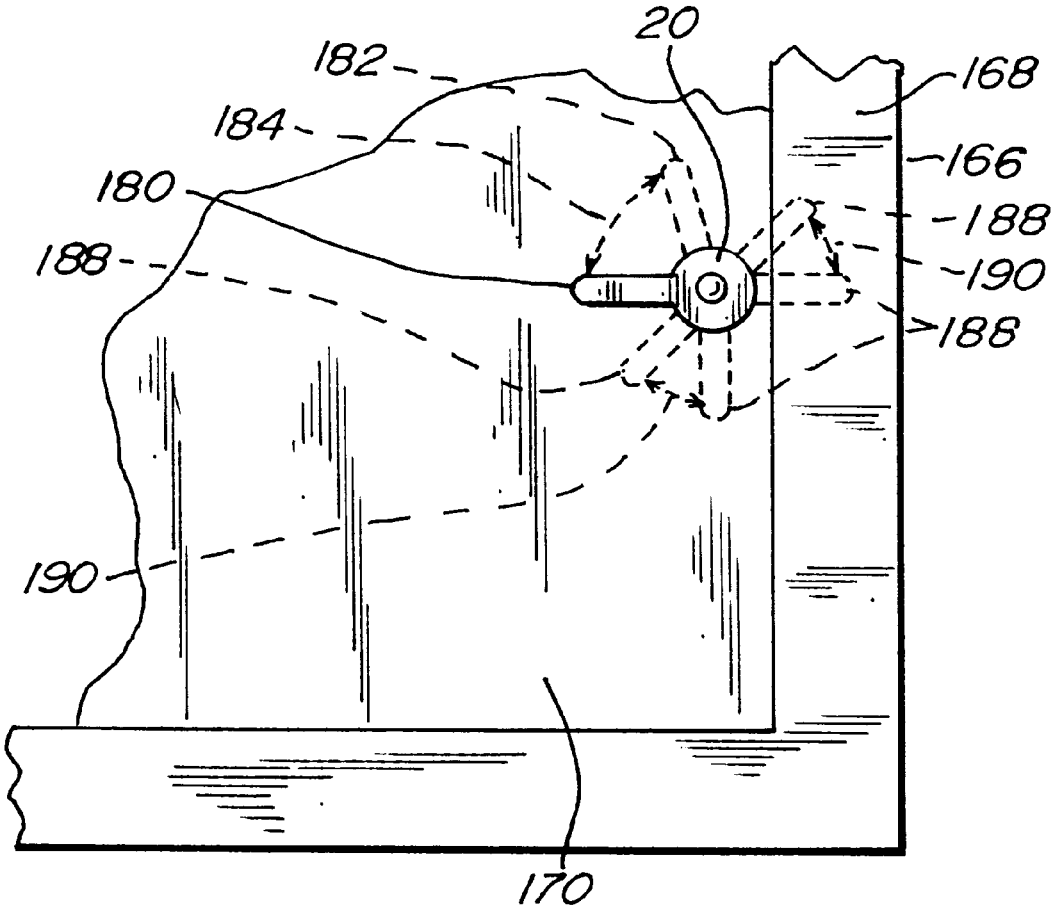
FIG. 9 is a schematic view showing different rotational positions of the handle and different range of rotations.

Referring to FIG. 9 the use of latching mechanism 20 on a cabinet 166 is illustrated. The cabinet has a door frame 168 and a door 170. Several different positions of the handle are shown with respective range of rotations. The handle 30 shown in the first position as indicated by the numeral 180 rotates from the first position to the upright position as indicated by the numeral 182 which is designated the second position and is the unlatched position for the latch assembly. The first position and second position define a range of rotation as indicated by the arrows designated with the numeral 184. Alternative placements of the handle are possible as indicated by the handles drawn in phantom in dashed lines and designated with the numeral 188 which each have their respective range of rotations 190. The different positioning of the handle are possible with the same latch assembly by way of altering the positioning of internal components and by rotating the base portion on the door.

Figure 8:
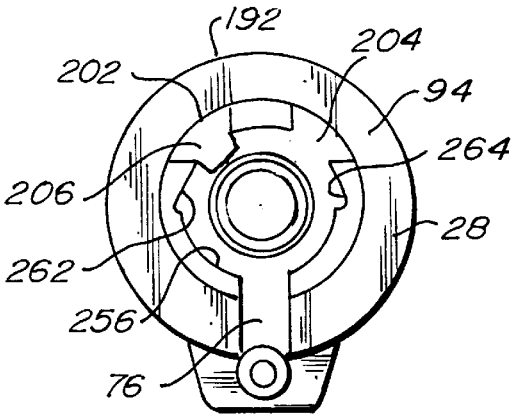
FIG. 8 is a front elevational view of the base portion with a key guide in place.
Figure 7:
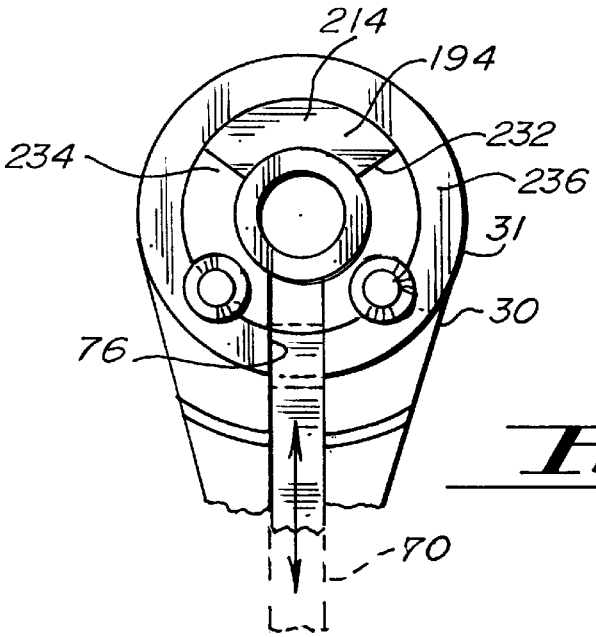
FIG. 7 is a front elevational view of the handle and shaft without the base portion and with the slide member in place.
Figure 5:
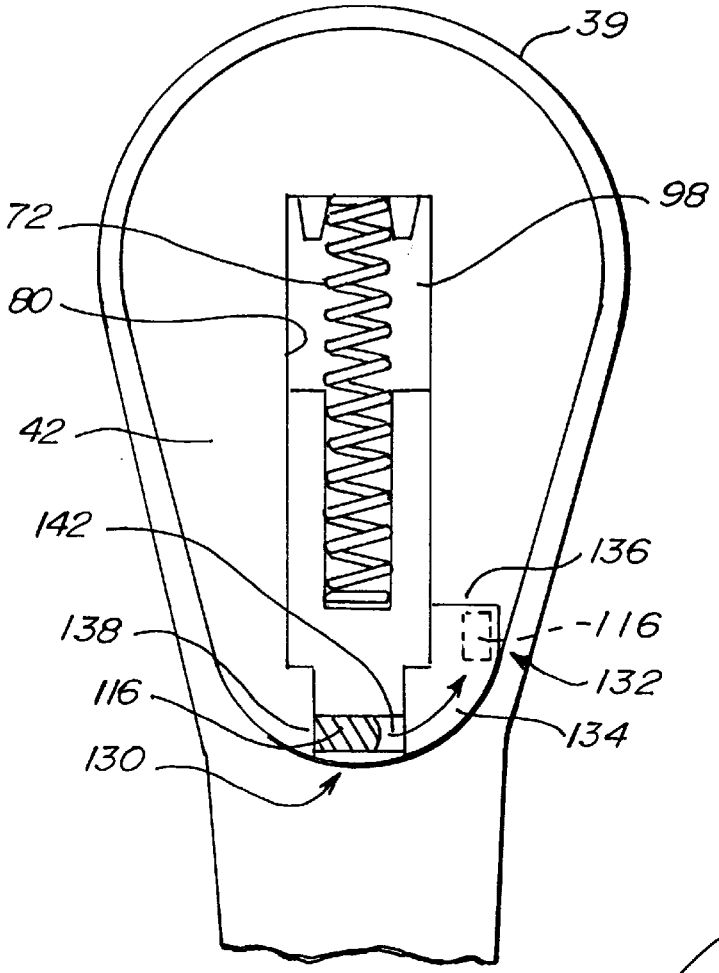
FIG. 5 is an elevational view of the end of the handle with the cap and shaft portion removed except for the obstructing portion.
Figure 6:
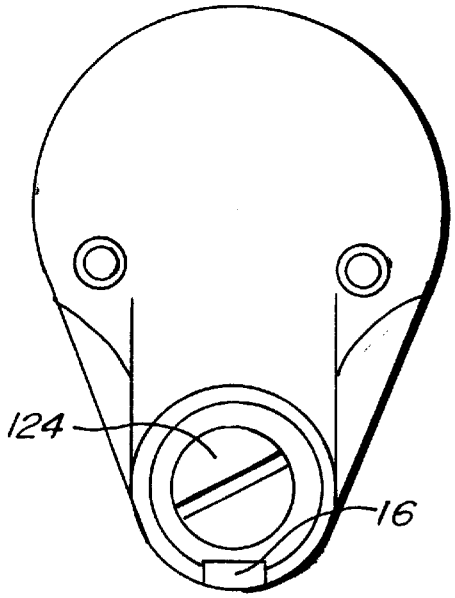
FIG. 6 is an elevational view of the inside of the cap with the shaft portion in place illustrating the obstructing portion.

Referring to FIGS. 2, 7, and 8, the base portion 28 and the handle each have cooperative rotation restriction portions 192, 194, respectively. The cooperative rotation restriction portion 192 on the base portion 28 has alternate seating recesses 202, 204, each recess configured to receive and engage a portion of a guide key 206. The other cooperative rotation restriction portion 194, as best shown on FIG. 7 and as also shown in FIG. 3A, has an open area 214 in which another portion of guide key 206 is allowed to rotate or arcuately translate. The open area and the range of rotation or arcuate translation of the guide key and thus the handle is defined by the opposing stops 232, 234 which are both integral with the handle in the preferred embodiment. The guide key 206 is shown as a separate component but it also is understood that said guide key can be integral with the base portion. Additionally the cooperating rotation restriction portions can be reversed as to the base portion and the handle. That is the guide key seating recesses 202, 204 could be on the front face 236 of the handle head portion 31 and the stops 232, 234 could be on the base portion. Additionally the stop portions could also be separate removable components similar to the guide key 206 to allow alteration or expansion of the range of rotation.

Referring to FIGS. 8 and 2, note that the frustoconical portion 94 of the base portion 28 has an interior surface 256 which is generally cylindrical in shape with the exception of the seating recesses 202, 204 and also to secondary detent recesses 262, 264. As the handle is rotated through its range of rotation, the slide member 70 is in the depressed or retracted position, although it is continually biased outward. Unless the trigger portion is being manually held in the depressed position, this bias outward causes the surface 196 of the detent 88 to continually engage said inside surface 256. At the secondary detent recesses 262, 264, the handle will be held in the specific position correlating to these recesses. For example, the handle as shown in FIG. 1 may be raised to an upright portion which would correspond to the detent 88 positioned in one of said recesses. This will operate to secure the handle in the more horizontal position and prevent the handle from falling to the down vertical position and inadvertently locking the cabinet. Note that the two secondary recesses as shown are applicable only in the convertible latching mechanism in which the guide key or similar means provides reconfiguration of the assembly.

Slot when used herein includes any opening accessible by a sliding member such as bores, grooves or the like. "Substantially" when used herein includes precisely that which is specified as well as not wholly or slightly more than that which is specified. "Shaft portion" may be an integral piece or may be an assembly. "Portion" when used herein may be part of an integral component, a separate component, or a combination of components and/or parts of components. "Mechanism" when used herein may be a single integral piece or more than one linked or engaged pieces.

The components parts may be conventionally formed from appropriate metals such as aluminum, steel, stainless steel, and zinc. Additionally, components may be machined or molded from suitable plastics.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A latch assembly adapted for attachment to a door in a door frame, the latch assembly comprising:

a) a base portion with a sleeve for attachment to the door, the sleeve for extending through the door, the base portion having a substantially radially extending first slot, and a first handle rotational restriction portion;

b) a shaft extending through the sleeve adapted for latching to the door frame;

c) a handle fixed to the shaft whereby the handle and shaft are at least partially rotatable with respect to the base portion between a first position and a second position, the handle having a head portion connecting to the shaft, a grasping portion extending from the head portion, and a cap receiving region on the head portion, the head portion configured for engagement with the base portion, the head portion including a second handle rotation restriction portion configured to cooperate with the first handle rotation restriction portion to limit the rotation of said handle and shaft with respect to the base portion, the head portion further including a substantially radially extending second slot positioned adjacent to the substantially radially extending first slot when the handle is in the first position;

d) a slide member slidingly engaged with respect to the latch assembly, the slide member having a depressed position and an extended position, the slide member configured such that when in the extended position the slide member is engaged with the first slot and the second slot thereby preventing rotation of the handle and shaft, the slide member further configured such that when in the depressed position the slide member is slidingly engaged in not more than one of the first slot and the second slot such that the handle and shaft may be rotated between the first position and the second position; and e) a cap positioned in the cap receiving region, the cap having a bore extending therethrough with a rotatable shaft portion positioned in said bore, the shaft portion having an externally rotatable first end, an opposite end, and an obstructing portion connected to said opposite end and movable into and out of an obstructing position with the slide member as the rotatable shaft portion is rotated.

2. The latch assembly of claim 1 wherein the slide member is biased towards engagement with the first slot and the second slot.

3. The latch assembly of claim 2, wherein the rotatable shaft portion is biased toward the obstructed position.

4. The latch assembly of claim 1 wherein one of the first and second rotation restriction portions have at least two guide key seating recesses and wherein the first and second rotation restriction portions are cooperatively engaged by a guide key seated in one of said guide key seating recesses, and wherein the guide key may be moved to one of the other guide key seating recesses.

5. The latch assembly of claim 1 wherein the externally rotatable first end comprises a tool receptacle.

6. The latch assembly of claim 1 wherein the slide member includes a protruding portion extending out from the head of the handle when the slide member is in the extended position and wherein the protruding portion is substantially contained within the head of the handle when the slide member is in the depressed position.

7. The latch assembly of claim 6, wherein the protruding member comprises a loop for receiving a padlock.

8. The latch assembly of claim 7, wherein the slide member has a reduced cross sectional portion where the protruding portion extends from the head of the handle whereby when the protruding portion receives an impact the slide member tends to fracture at said reduced cross sectional portion inhibiting movement of the slide member from the extended position to the depressed position.

9. The latch assembly of claim 1 wherein the externally rotatable first end comprises a key cylinder.

10. A latch assembly adapted for attachment to a door in a door frame, the latch assembly comprising:

a) a base portion having an aperture;

b) a shaft having a longitudinal axis, the shaft extending through the aperture of the base portion for latching a door with respect to a door frame;

c) a handle fixed to the shaft whereby the handle and shaft are at least partially rotatable with respect to the base portion between a first position and a second position, the handle having a head portion connecting to the shaft, a grasping portion extending from the head portion, the head portion configured for rotatable engagement with the base portion;

d) a first release mechanism positioned in the head portion and having a protruding portion extending from said head portion, the first release mechanism radially movable relative to the longitudinal axis of the shaft between a depressed position and an extended position, the first release mechanism configured such that when in the extended position the first release mechanism interferes with the rotation of the handle and shaft with respect to the base portion, the first release mechanism further configured such that when in the depressed position the handle and the shaft may be rotated relative to the base portion between the first position and the second position;

e) a second release mechanism linked with the first release mechanism, the second release mechanism having an obstructing position and a nonobstructing position, the second release mechanism configured such that in the obstructing position the second release mechanism obstructs the operation of the first release mechanism, the second release mechanism manipulatable to move between the obstructing and nonobstructing positions;

f) a slide member slidingly engaged to said assembly, said slide member having a reduced cross-sectional portion where the protruding portion extends from the head portion of the handle whereby when the protruding portion receives an impact the slide member tends to fracture at said reduced cross-sectional portion inhibiting movement of the slide member from the extended position to the depressed position.

11. A latching assembly for a door which engages a door frame, the door having an interior and an exterior, the assembly comprising a base portion having an aperture; a shaft which extends through the aperture of the base portion, the shaft at least partially rotatable with respect to the base portion; a handle connecting to the shaft portion and having a grasping portion extending substantially normally to the shaft allowing at least partial rotation of said shaft as the handle is rotated; a first release mechanism comprising a trigger portion extending from the handle in a direction substantially normal to the shaft and a detent mechanism with a detent engageable with a detent recess in the base portion thereby preventing rotation of the handle and shaft with respect to the base portion, said detent configured to release from the recess by movement of the trigger portion towards the handle; a cap covering the detent mechanism and wherein the cap has an opening extending to the detent mechanism and wherein the latching assembly further comprises a secondary release mechanism constrained in said opening and moveable into and out of an obstructing position with the first release mechanism, the secondary release mechanism configured such that when in the obstruction position movement of the trigger toward the handle is inhibited.

12. The latching assembly of claim 11 wherein the secondary release mechanism is comprised of a rotatable shaft portion rotatable with respect to the cap, the shaft portion having a first end exteriorly exposed with respect to the handle and manipulatable to rotate said shaft portion and a second end with a obstructing portion to blockingly engage with the first release mechanism.

13. The latching assembly of claim 11 wherein the first end of the shaft portion is comprised of one of the set comprising: a key cylinder, a manually manipulable member, and a tool receptacle.

14. The latching assembly of claim 13 wherein the handle has a first position in which the detent is engaged in the detent recess and a second position in which the detent is engaged in a secondary detent recess to hold the handle in said second position.

15. The latch assembly of claim 14 further comprising a first release mechanism comprising a trigger portion extending from the handle and a detent mechanism in the assembly with a detent engaging with a detent recess in the base portion thereby preventing rotation of the handle and shaft with respect to the base portion, said detent mechanism configured to release from the recess by movement of the trigger portion towards the handle; and a cap portion covering said detent mechanism.

* * * * *